United States Patent [19]

Wheeler

[11] Patent Number: 4,852,234

[45] Date of Patent: Aug. 1, 1989

[54] PULLER ASSEMBLY

[75] Inventor: Daryl Wheeler, Lesmurdie, Australia

[73] Assignee: Haben Corporation Ltd., Bayswater, Australia

[21] Appl. No.: 153,275

[22] PCT Filed: Feb. 5, 1987

[86] PCT No.: PCT/AU87/00032

§ 371 Date: Oct. 7, 1987

§ 102(e) Date: Oct. 7, 1987

[87] PCT Pub. No.: WO87/04965

PCT Pub. Date: Aug. 27, 1987

[30] Foreign Application Priority Data

Feb. 13, 1986 [AU] Australia ..... PH4585

[51] Int. Cl.[4] ..... B23P 19/04

[52] U.S. Cl. ..... 29/261

[58] Field of Search ..... 29/258, 256, 262, 261, 29/265, 259

[56] References Cited

U.S. PATENT DOCUMENTS 1,890,369 12/1932 Cook ..... 29/261
2,052,304 8/1936 Kaplan ..... 29/262

FOREIGN PATENT DOCUMENTS 0135490 3/1985 European Pat. Off. .
851778 10/1952 Fed. Rep. of Germany .
1046590 12/1953 France .
1111638 3/1956 France .
8500546 2/1985 PCT Int'l Appl. .

OTHER PUBLICATIONS 672,390, United Kingdom.

*Primary Examiner*—Robert C. Watson
*Attorney, Agent, or Firm*—John S. Hale

[57] ABSTRACT

A puller assembly (10,42) comprising at least two angled brackets (12) each pivotally secured at a first end (14) to a base (18), each of the angled brackets (12) having a second end (16) remote from the first end (14) and disposed oppositely with respect to the base (18), a screw means (24) threadedly engaged with the second ends (16) and disposed so as to allow adjustment of the distance between the second ends (16), a drive bolt (20) threadedly engaged in the base (18) centrally of the angled brackets (12) and a leg (32) pivotally fixed to a respective one of the angled brackets (12) and disposed to attach to an object to be pulled.

9 Claims, 3 Drawing Sheets

PULLER ASSEMBLY

DESCRIPTION

The present invention relates to a puller assembly particularly envisaged for use in pulling bearings from shafts or as a clamp or the like.

The puller assembly of the present invention will hereinafter be described with particular reference to a bearing puller although it is to be understood that it is of general applicability.

FIELD OF THE INVENTION

In general, bearing pullers comprise two or three legs pivotally mounted on a base and arranged to locate about the perimeter of a pulley on a shaft and a drive bolt arranged centrally of the legs and threadedly engaged with the base. The drive bolt is, in use, rested against an end of the shaft having the bearing fitted onto it. The drive bolt is disposed axially in line with the shaft. The drive bolt is then rotated such as with a shifter to threadedly propagate through the base and draw the legs toward the end of the shaft. Consequently the bearing is pulled along the shaft toward the same end.

In such an apparatus the shifter is rotated in a plane normal to the axis of the shaft and since there is friction between the drive bolt and the shaft torque applied to the drive bolt by the shifter is transmitted to the shaft. Where the shaft is an axle it tends to rotate and so it is necessary to immobilize the axle so that the puller will operate. To immobilize the axle often requires the help of another person.

When the shaft is prevented from rotation the drive bolt rotates on the shaft end subject to the said friction and in accordance with the applied torque. Rotation of the drive bolt with respect to the end of the shaft in such prior art puller assemblies is essential in drawing the legs toward the end of the shaft. It is common for such frictional rotation to damage the end of the shaft either by slipping off the end or by deforming a detent provided in the shaft end for centering purposes. The mechanical advantage available with such prior art bearing pullers is limited to the length of the shifter and the restraining force that can be applied to the shaft, where the shaft is subject to rotation.

SUMMARY OF THE INVENTION

The present invention provides a puller assembly in which the drive bolt is not required to rotate with respect to the end of a shaft from which a bearing or the like is to be removed.

In accordance with the present invention there is provided a puller assembly characterised in that it comprises at least two angled brackets each pivotally secured at a first end to a base, each of the angled brackets having a second end remote from the first end and disposed oppositely with respect to the base, a screw means threadedly engaged with the second ends and disposed so as to allow adjustment of the distance between the second ends, a drive bolt threadedly engaged in the base centrally of the angled brackets and a leg pivotally fixed to a respective one of the angled brackets and disposed to attach to an object to be pulled.

Preferably each of the first ends of the angled brackets comprises a cog disposed to engage a cog of an adjacent angled bracket.

BRIEF DESCRIPTION OF THE DRAWINGS

The present invention will now be described, by way of example, with particular reference to the accompanying drawings, in which.

DESCRIPTION OF THE INVENTION

Figure 1:
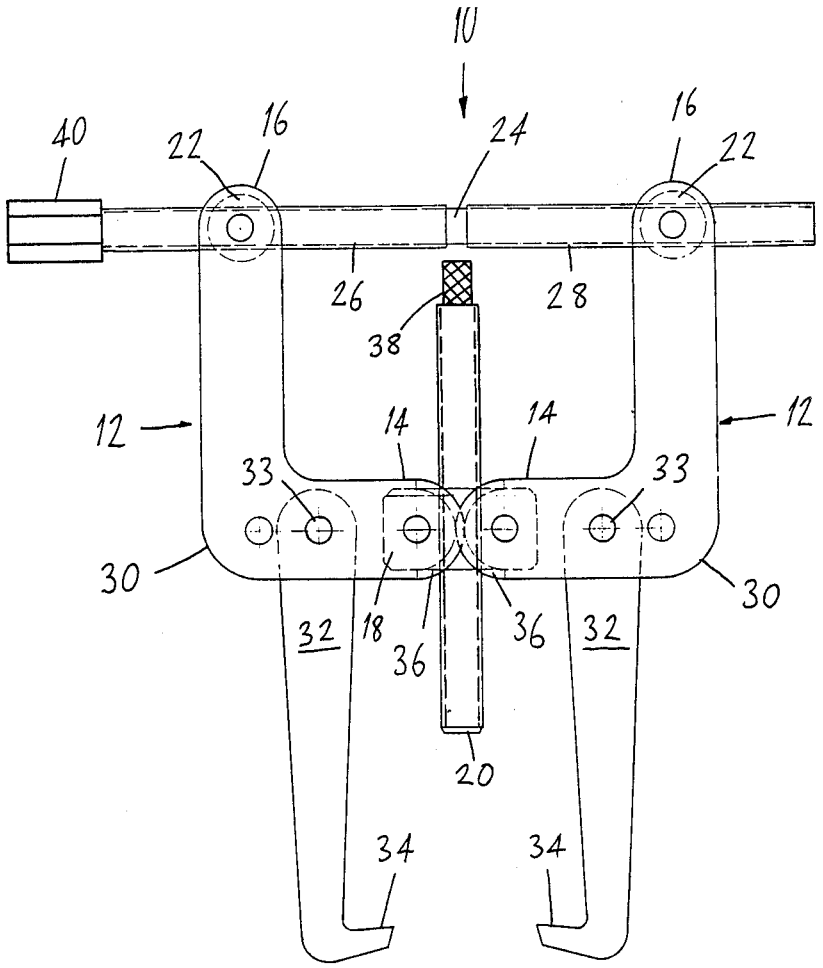
FIG. 1 is a side view of a puller assembly in accordance with a first embodiment of the present invention.

In FIG. 1 there is shown a puller assembly 10 comprising two angled brackets 12 each having a first end 14 and a second end 16 remotely located from the first end. The brackets 12 are pivotally secured to a base 18 at the first end 14. The base 18 comprises a centrally located threaded hole (not shown) arranged to be threadedly engaged by a drive bolt 20.

Figure 2:
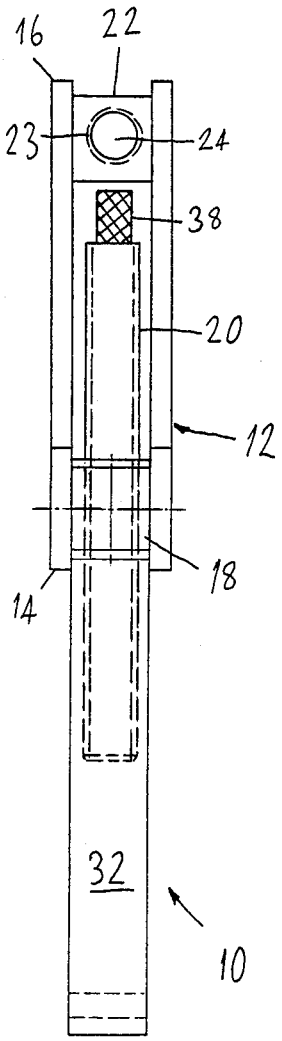
FIG. 2 is an end view of the puller assembly of FIG. 1.

The second ends 16 are disposed oppositely with respect to the base 18 as shown in FIG. 1. Each of the second ends 16 has a respective block 22 pivotally fixed in it. Each of the blocks 22 has an internally threaded hole 23 (FIG. 2) disposed to receive a screw means such as a lead screw 24. The lead screw 24 has a right handed thread formed in a first half 26 and a left hand thread formed in a second half 28 or vice versa. Thus, rotation of the lead screw 24 results in equal inward or outward displacement of each of the second ends 16 simultaneously.

Since the brackets 12 are pivotally secured to the base 18 rotation of the lead screw 24 produces a corresponding degree of pivot about the base 18. The brackets 12 each comprise an elbow 30 located intermediately of the first and second ends 14 and 16. A leg 32 is pivotally fixed to each of the brackets 12 at a pivot 33 located intermediately of a respective one of the elbows 30 and the first ends 14. In one form of the invention the legs 32 are elongated and comprise a lip 34 at an end remote from the pivot 33. The lips 34 are intended, in use, to be attached to an object such as a bearing or the like, by location about the perimeter of the bearing to pull same from a shaft.

It has been found that where the brackets 12 are allowed to freely pivot at the first and second ends 14 and 16 the trapezoid formed may collapse unless supported. Such is a particular problem where unequal forces are exerted on each of the legs 32. Therefore, it is preferred that each of the first ends 14 having a toothed cog schematically shown in FIG. 1 and assigned reference numeral 36. Each of the cogs 36 is disposed to engage with an adjacent cog 36 so that the angle of each of the brackets 12 with respect to the drive bolt is equal. Such a preferment has the result that the drive bolt 20 bisects the angle between the base 18 and the second ends 16. Thus, the puller assembly 10, with the cogs 6, is self supporting and will not collapse if subjected to unequal forces on each of the legs 32, in noraml operation.

It is envisaged that the puller assembly 10 could comprise a leg 32 having a form other than that shown in FIG. 1 to allow adaptation of the puller assembly 10 as a clamp, for example. In such a case the lips 34 could be in the form of "T"'s and arranged to be slid into correspondingly shaped "T" troughs in a milling machine bed or the like. It is envisaged that the puller assembly 10 could comprise more than two brackets 12 and corresponding legs 32, such as, for example, 3 brackets 12 and legs 32. In use, the puller assembly 10 is arranged to remove bearings or the like from shafts or the like. The lips 34 are located about the perimeter of the bearing, for example, or some other convenient location and preferably equispaced about the perimeter of the bearing. The drive bolt 20 is then rotated by gripping a knurled head 38 of the drive bolt 20 to thread into the threaded hole in the base 18 until the end of the drive bolt 20 contacts the end of the shaft.

Once the puller assembly 10 is in place a shifter may be applied to a bolt head end 40 of the lead screw 24 in order to rotate the lead screw and drive the second ends 16 together. Simultaneously the legs 32 are drawn toward the drive bolt 20 and the bearing is pulled along the shaft toward the free end of the shaft.

Figure 4:
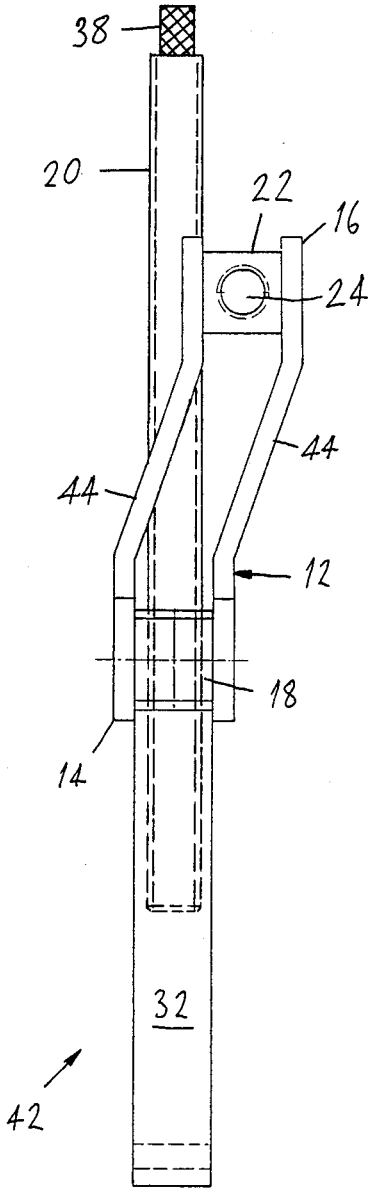
FIG. 4 is an end view of the puller assembly of FIG. 3.
Figure 3:
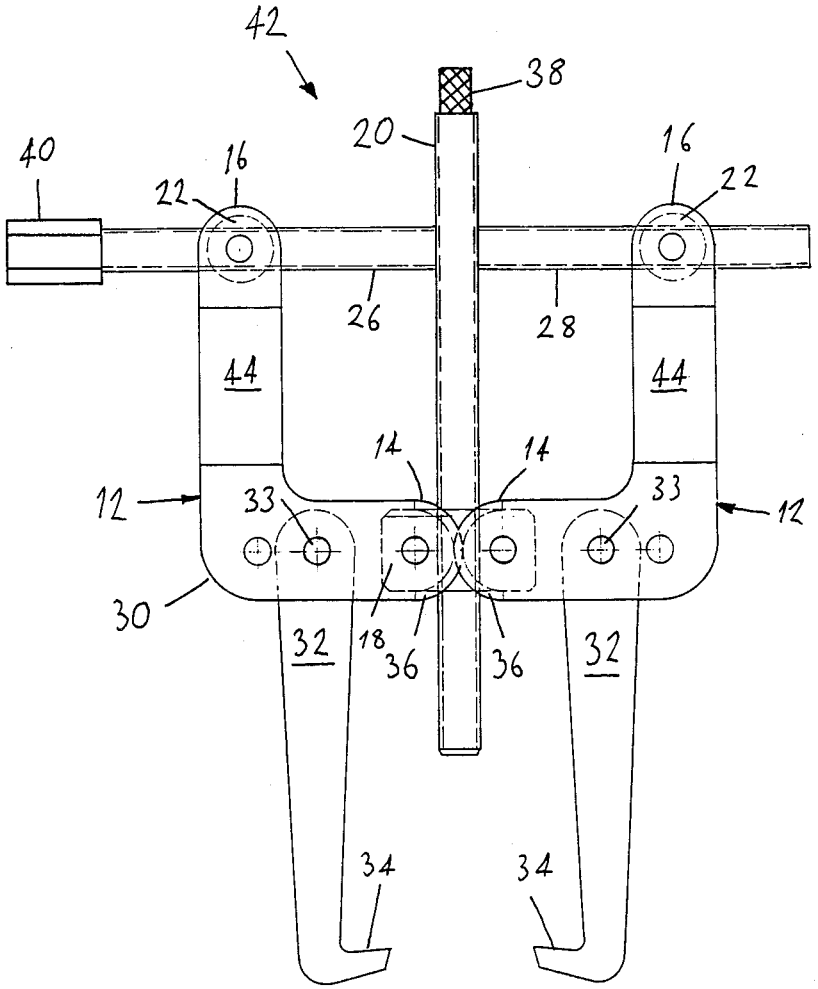
FIG. 3 is a side view of a puller assembly in accordance with a second embodiment of the present invention.

In FIGS. 3 and 4 there is shown a further embodiment of a puller assembly 42 of the present invention and like numerals denote like parts. As particularly shown in FIG. 4 the angled brackets 12 each comprise an offset 44 located between the elbow 30 (FIG. 3) and the second end 16 of each bracket 12.

In use, the puller assembly 42 is operated similarly to the puller assembly 10 except that the drive bolt 20 may be travelled longitudinally in the base 18 so that the knurled head 38 extends past the lead screw 24.

As the lead screw 24 is rotated the shifter exerts a torque that is in a plane parallel to axis of the shaft and so no torque is transmitted to the shaft in such a way as to cause the shaft to rotate. Therefore, it is not necessary to immobilize a rotatable shaft. Furthermore, the drive bolt 20 is intended to be maintained stationary with respect to the shaft. Such features allow the use of impulse drivers such as pneumatic impact drivers to assist in removal of tight bearings.

If impulse drivers are used with conventional puller assemblies the abovementioned difficulties, experienced with conventional puller assemblies, are compounded since an impulsive torque must be applied to the drive bolt whilst maintaining the shaft stationary.

Also, since the drive bolt 20 of the puller assembly 10 is stationary with respect to the end of the shaft it is less prone to slipping off the shaft or otherwise damaging the end of the shaft. Since the pulling force is not transmitted by rotating the drive bolt 20 the drive bolt 20 may be provided with a multistart thread such as a dual start thread. Such threads can maintain a similar static load to a single start thread but may be adjusted more rapidly. Conventional puller assemblies may not employ multistart threads since they are not suitable to transmit large torques such as those that can be transmitted by single start threads.

Modifications and variations such as would be apparent to a skilled addressee are deemed within the scope of the present invention. For example, the size of the brackets 12 and the location of the pivot connection of the legs 32 to the brackets 12 may be changed and/or adjusted to alter the mechanical advantage given to the lead screw 24.

Also, the legs 32 may comprise outwardly projecting lips 34 so as to allow for internal pulling.

I claim:

1. A puller assembly comprising at least two angled brackets, each angled bracket having a first end and second end remote from the first end and an elbow located intermediate the first end and second end, the second ends of the angled brackets being pivotally mounted to a base, a screw means threadedly engaged with the second ends of the angled brackets, a drive bolt threadedly engaged in the base centrally of the angled brackets, the drive bolt having an end arranged to be fixed in motion with a stationary shaft from which an object is to be pulled, and at least two legs pivotally attached one to each angled bracket, each leg having a lip remote from the respective angled bracket, each lip being disposed to attached about said object, the drive bolt being threadedly moveable in the base to vary the distance between said end and said lips independent of the action of the screw means, the screw means being disposed substantially at right angles with respect to the drive bolt so that rotation of the screw means in one direction causes movement of said first ends of the angled brackets toward each other and movement of the lips in a direction toward said end of the drive bolt to pull said object off said shaft, and rotation of the screw means in an opposite direction causes movement of said first ends of the angled brackets away from each other and movement of the lips in a direction away from said end of the drive bolt to disengage said lips from said object.

2. A puller assembly according to claim 1, wherein said screw means is disposed so that torque is applied to it in a plane parallel to a longitudinal axis of said drive bolt to avoid rotation of the puller assembly on the shaft due to application of said torque.

3. A puller assembly according to claim 1, including a toothed cog provided at said first end of each of the angled brackets, the toothed cogs of adjacent angled brackets engaging so that each one of the angled brackets is kept at the same angle to said base to each other one of said angled brackets.

4. A puller assembly according to claim 1, wherein each of the angled brackets comprises an offset located between said elbow and said second end to allow the drive bolt to be threaded in the base past the screw means.

5. A puller assembly according to claim 2, wherein the screw means is responsive to an impulsive torque drive drawing said first ends of the angled brackets toward each other to thereby impulsively move said lips toward said end of the drive bolt against the retarding force of said object engaged on said shaft.

6. A puller assembly comprising at least two angled brackets, each pivotally secured at a first end to a base, each of the angled brackets having a second end remote from the first end and disposed oppositely with respect to the base, a screw means threadedly engaged with the second ends and disposed so as to allow adjustment of the distance between the second ends, a drive bolt threadedly engaged in the base centrally of the angled brackets, at least two legs pivotally attached one to each of the angled brackets and disposed to attached to an object to be pulled from a shaft, and a toothed cog provided at said first end of each of the angled brackets, the toothed cogs of adjacent angled brackets engaging so that each one of the angled brackets is kept at the same angle to the base as each other one of the angled brackets.

7. A puller assembly, according to claim 6, in which said screw means is disposed such that torque is applied to it in a plane parallel to a longitudinal axis of the drive bolt to avoid rotation of the puller assembly on the shaft due to application of said torque.

8. A puller assembly according to claim 7, in which the screw means is disposed to be responsive to an impulse torque drive to receive an impulsive torque to draw said first ends of the angled brackets toward each other to thereby impulsively pull said object off said shaft.

9. A puller assembly characterised in that it comprises at least two angled brackets each pivotally secured at a first end to a base, each of the angled brackets having a second end remote from the first end and disposed oppositely with respect to the base, a screw means threadedly engaged with the second ends and disposed so as to allow adjustments of the distance between the second ends, a drive bolt threadedly engaged in the base centrally of the angled brackets and a leg pivotally fixed to a respective one of the angled brackets and disposed to attach to an object to be pulled, each of the angled brackets comprising an elbow located intermediately of the first end and the second end and an offset located between said elbow and the second end to allow the drive bolt to be threaded in the base past the screw means.

* * * * *